United States Patent [19]

Uchida

[11] 4,383,541

[45] May 17, 1983

[54] COIN ACCUMULATOR ASSEMBLY FOR COIN WRAPPING MACHINE

[75] Inventor: Isamu Uchida, Tokyo, Japan

[73] Assignee: Laurel Bank Machine Co., Ltd., Tokyo, Japan

[21] Appl. No.: 187,991

[22] Filed: Sep. 17, 1980

[30] Foreign Application Priority Data

Sep. 21, 1979 [JP] Japan ..... 54-121817

[51] Int. Cl.[3] ..... G07D 9/00

[52] U.S. Cl. ..... 133/8 A; 53/212

[58] Field of Search ..... 198/532; 133/1 A, 5 R, 133/8 R, 8 A; 53/212, 254; 193/DIG. 2; 221/296

[56] References Cited

U.S. PATENT DOCUMENTS

| | | | |
|---|---|---|---|
| 1,632,344 | 6/1927 | Modlin | 53/212 |
| 3,382,647 | 5/1968 | Davey et al. | 53/254 |
| 3,604,432 | 9/1971 | McCollough | 133/8 R |
| 3,815,763 | 6/1974 | Biloco et al. | 198/532 |

FOREIGN PATENT DOCUMENTS

| | | | |
|---|---|---|---|
| 2625698 | 12/1977 | Fed. Rep. of Germany | 53/222 |
| 18579 | 2/1909 | Norway | 133/8 R |

*Primary Examiner*—H. Grant Skaggs

*Attorney, Agent, or Firm*—Fleit, Jacobson & Cohn

[57] ABSTRACT

An improved coin accumulator assembly is provided, which comprises a main accumulator tube adapted to receive and accumulate therein a pre-set number of coins and a subsidiary accumulator tube disposed upstream of the main accumulator tube and adapted to receive and accumulate temporarily the coins counted during the early stage of counting operation when the main accumulator tube is involved in the coin delivery operation and hence cannot receive any coins. The coins temporarily accumulated in the subsidiary accumulator tube are collectively passed to the main accumulator tube when the latter is released from the coin delivery operation and restored to its normal coin receiving condition. By the use of the coin accumulator assembly of the invention, the time period used for counting the coins included in one cycle operation of the coin wrapping machine can be increased to improve the efficiency or the coin feeding rate may be lowered to make it possible to control the coin counting operation more precisely and more reliably.

4 Claims, 2 Drawing Figures

COIN ACCUMULATOR ASSEMBLY FOR COIN WRAPPING MACHINE

BACKGROUND OF THE INVENTION

1. Field of the Invention

The present invention relates to a coin wrapping machine, and more particularly to a coin accumulator tube assembly for receiving to accumulate therein a predetermined number of coins prior to wrapping the same.

The coin wrapping machine commonly used at the present day is provided with vertical guide means by which the accumulated coins are guided vertically from the accumulator tube upon opening the shutter provided at the bottom of the tube while being carried by a carrier link mechanism to a wrapping roller assembly, or alternatively provided with horizontal guide means in combination with a partible accumulator tube from which a pile of accumulated coins is guided in the horizontal direction while being carried by clamping levers press fitting on the diametrically opposed edges of the pile of accumulated coins.

The coin accumulator tube assembly of the present invention is particularly suited for use in combination with the aforementioned vertical guide means, and also may be used in combination with the horizontal guide means with some modification.

2. Prior Art

In the conventional coin wrapping machine, after a predetermined number of coins has been counted and accumulated in the accumulator tube, the counting operation is interrupted and simultaneously the feeding of coins is stopped. The shutter provided at the bottom of the accumulator tube is then opened to deliver the pile of coins accumulated in the tube onto the carrier link mechanism which has been positioned beneath the shutter to receive and to lower the coins to the wrapping station. After the coins are lowered below the shutter level and transferred to the wrapping station, the shutter is again closed. The next cycle coin feeding and counting operation is started upon generation of a signal indicating that the coins of the preceding cycle have been already wrapped by a wrapping sheet material, whereby the coins are again fed to the accumulator tube to be accumulated therein.

In other words, in the conventional coin wrapping machine, after an appreciable delay from the time at which the accumulated coins of the first cycle reached the wrapping station, a signal for instructing to initiate the succeeding cycle counting operation is generated, so that the operation of counting and accumulating the coins takes place during only about one half of one cycle operation including the step of counting and accumulating the coins, the step of delivering or transferring the accumulated coins onto the wrapping station and the step of wrapping the coins. Since the operation of counting and accumulating the coins can occupy only half of one cycle operation, the coins must be fed at a relatively high speed by increasing the circumferential speed of the counting gear. However, this has a disadvantage in that an erroneous counting frequently arises from the inertia of the counting gear rotating at a higher speed.

DESCRIPTION OF THE INVENTION

Summary and Object of the Invention

The primary object of the present invention is to provide a coin accumulator tube assembly for a coin wrapping machine which can eliminate the aforementioned disadvantage.

The aforementioned primary object has been attained, according to the present invention, by the provision of means for fractionizing the accumulation of coins. More specifically, the accumulator tube assembly according to the present invention includes an additional or subsidiary accumulator tube disposed above or upstream of the conventional main accumulator tube. The main and subsidiary accumulator tubes are cooperatively associated with each other such that coins are continuously counted and accumulated in the subsidiary accumulator tube while the pile of coins accumulated by the preceding cycle is just being handled by a carrier link mechanism or a clamping lever mechanism to be discharged from the main accumulator tube and the coins thus accumulated temporarily in the subsidiary tube are collectively transferred to the main accumulator tube after the latter mentioned tube is again closed to be ready for receiving the coins. As an additional effect of the fractionized accumulation, the counting and accumulating operation may be performed more precisely and reliably, since the coin feeding rate can be lowered and thus the coins are counted at a steady rate.

It is, therefore, another important object of the present invention to provide a coin wrapping machine provided with the coin accumulator assembly of the invention, whereby the coin counting and accumulating operation can be performed more reliably and steadily.

It is a further object of the present invention to provide a coin accumulator assembly by the use of which the risk of erroneous counting can be spontaneously excluded.

A still further object of the present invention is to provide a coin wrapping machine which can be operated efficiently to complete its one cycle operation for a short period of time.

DESCRIPTION OF THE DRAWING

Other objects and advantages of the present invention will become apparent from the following detailed description of the preferred embodiment with reference to the accompanying drawing, in which.

DESCRIPTION OF THE PREFERRED EMBODIMENT

The present invention will now be described in detail by referring to a preferred embodiment shown in the appended drawing.

Figure 1:
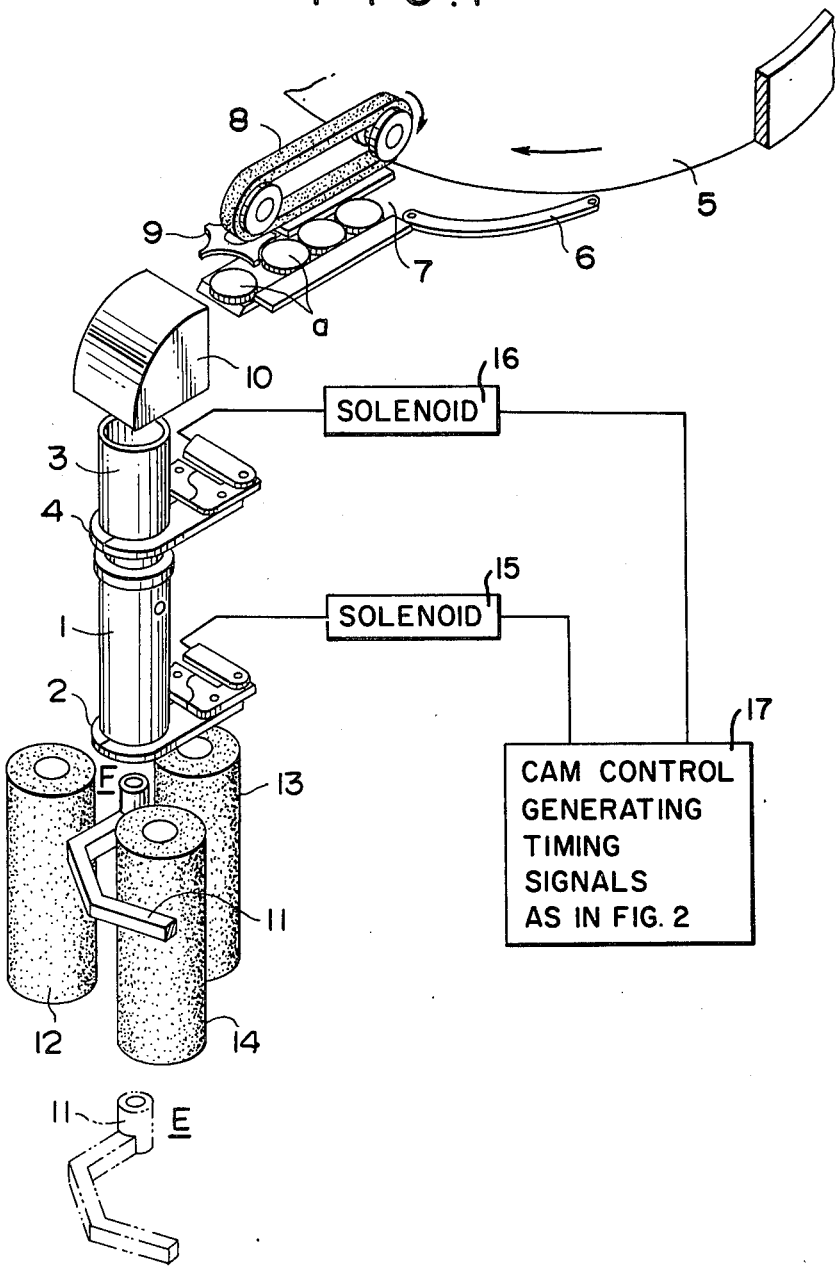
FIG. 1 is a perspective view showing somewhat diagrammatically the main parts of an embodiment of the invention.

Referring firstly to FIG. 1 which shows diagrammatically the main parts of the coin accumulator assembly of the present invention adapted to deliver the pile of the accumulated coins along the vertical pass line onto a coin wrapping station. The embodiment shown in FIG. 1 comprises a main accumulator tube 1 which is a typical vertical supply tube used in the conventional coin wrapping machine and provided with a main shutter 2 disposed at the bottom thereof, and a subsidiary accumulator tube 3 positioned adjacently above the main accumulator tube 1 and provided with a subsidiary shutter 4 at the boundary of the tubes 1 and 3. Coins fed onto a rotary disk 5 move along the peripheral portion of the disk to be given with centrifugal forces, and then guided by a guide 6 into a coin passage 7 one by one. The coins are forcibly conveyed by a conveyer belt 8 along the coin passage 7 through which different sorts of coins, for example, those of smaller diameters, are removed to select a kind of coins a to be wrapped. Each of the coins a is engaged with each tooth of a counting gear 9 to rotate the counting gear 9 associated with a counting mechanism (not shown) which may be set to count a predetermined number of coins and to stop the rotational movement of the counting gear 9 to prevent a further coin a from passing therethrough when the predetermined number of coins has been counted. In the conventional device, the coins a passing through the counting gear 9 fall through a chute 10 directly into the main accumulator tube 1. According to the present invention, the coins are fed through the subsidiary accumulator tube 3 and the coins fed at the early stage of counting are accumulated in the subsidiary accumulator tube 3, since the subsidiary shutter 4 is closed while the main shutter 2 is opened to transfer the pile of accumulated coins of preceding cycle to a delivering means in the form of a carrier link 11 to be guided to the wrapping station. As the pile of coins of preceding cycle is lowered to the position at which the upper end thereof passes by the bottom face of the main shutter 2, the main shutter 2 is again closed and the subsidiary shutter 4 is opened after a short time delay, whereupon the coins accumulated in the subsidiary accumulator tube 3 fall into the main accumulator tube 1 and the succeeding coins continuously counted by the counting gear 9 pass through the subsidiary accumulator tube 3 to the main accumulator tube 1 until the predetermined number of coins is accumulated in the main accumulator tube 1. The time period in which the coins are temporarily accumulated in the subsidiary accumulator tube 3 occupies about one third of the time period required for the whole counting operation, so that the length or height of the subsidiary accumulator tube may be about one third of that of the main accumulator tube. The shutters 2 and 4 may be opened and closed, for example by solenoids 15 and 16, respectively, or other suitable mechanisms, in response to the operation signals generated sequentially by a cam control 17 as will be described hereinafter.

Concurrently with the counting operation, the pile of coins of preceding cycle delivered to the wrapping station is clamped and rotated by wrapping rollers 12, 13 and 14 by which a sheet of wrapping paper is wound around the pile of coins. After the wrapping operation is completed by crimping the ends of the wrapping sheet, the wrapped pile of coins is released from the clamping action of the wrapping rollers 12, 13 and 14 and then discharged from the wrapping station. Then, the carrier link 11 is raised at a position just beneath the main shutter 2 to be ready for receiving the pile of coins. Until that time, the counting and accumulating operation has been completed and the predetermined number of coins is accumulated in the main accumulator tube 1. Upon arrival of the carrier link 11 at the raised position, a signal for instructing to close the subsidiary shutter 4 and a signal for instructing to open the main shutter 2 are generated and the coins accumulated in the main accumulator tube 1 are transferred to the carrier link 11 while allowing to initiate next cycle counting operation to accumulate coins in the subsidiary accumulator tube 3.

To facilitate full understanding of the present invention, one cycle operation of the coin wrapping machine incorporated with the coin accumulator tube assembly according to the invention will now be described with reference to the time chart shown in FIG. 2.

Figure 2:
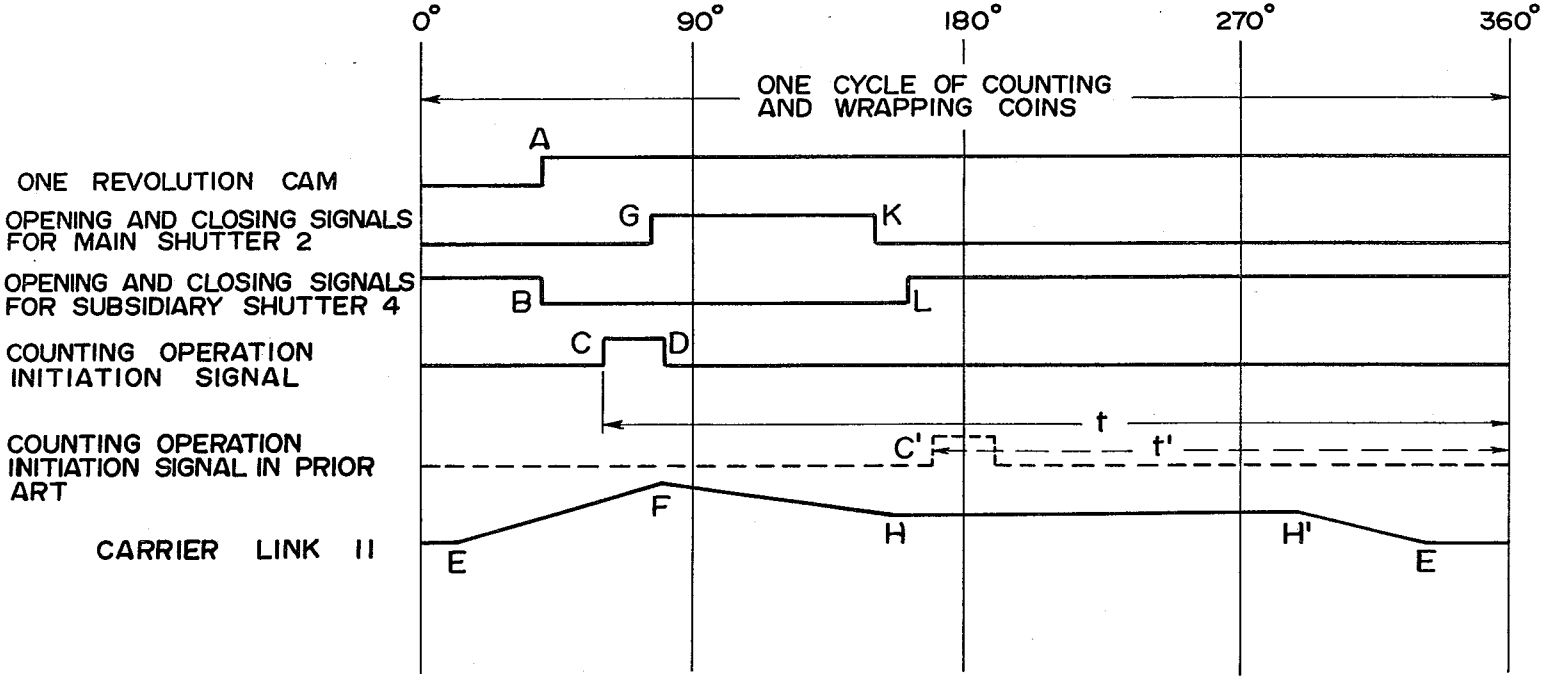
FIG. 2 is a time chart showing one cycle operations of the coin wrapping machines respectively provided with a prior art coin accumulator tube and the coin accumulator tube assembly of the present invention.

One cycle of counting and wrapping the coins is controlled in the cam control 17 by one revolution cam which generates timing signals as in FIG. 2 starting with an operation initiation signal A. Simultaneously with the generation of signal A, a signal B for instructing to close the shutter 4 is generated to close the same. Then, a counting operation initiation signal C-D is generated to actuate the conveyer belt 8 and to release the stopper in the counting mechanism associated with the counting gear 9. The counting gear 9 is rotated to count the coins in response to the passage of coins one at a time, and the coins fed to the subsidiary accumulator tube 3 during this initial stage of counting are accumulated temporarily in the subsidiary accumulator tube 3 since the shutter 4 is closed. During this initial stage of counting, the carrier link 11 is shifted from its lowermost position E to the uppermost position F just beneath the main shutter 2. Upon arrival of the link 11 to the position F, a main shutter opening signal G is generated to open the main shutter 2 and the pile of coins counted and accumulated in the main accumulator tube 1 by the preceding operation cycle is delivered to the carrier link 11 to be lowered to a wrapping position H. When the carrier link 11 reaches the wrapping position H, a main shutter closing signal K is generated to close the main shutter 2. Shortly after, a subsidiary shutter opening signal L is generated to open the subsidiary shutter 4, whereupon the coins accumulated in the subsidiary accumulator tube 3 fall within the main accumulator tube 1. The counting operation is continued without interruption at any moment of aforementioned operations, and the coins which are fed in the subsidiary accumulator tube 3 after the shutter 4 is opened are not accumulated in the subsidiary accumulator tube 3 any longer but pass therethrough to be accumulated in the main accumulator tube 1. After the predetermined number of coins is accumulated in the tube 1, the counting operation is stopped by the action of a stopper until the counting initiation signal C for instructing to start the next cycle is generated. Concurrently with the aforementioned counting and accumulation operations, the pile of coins counted and accumulated by the preceding operation cycle is wrapped while carried by the carrier link 11 at the wrapping station during the time period shown by H-H' in FIG. 2 and then discharged from the wrapping station while the link 11 is held at its lowermost position shown by E in FIG. 2.

As has been described hereinbefore, the predetermined number of coins a has been accumulated in the main accumulator tube 1 and the carrier link 11 has been raised at its uppermost position before the main shutter opening signal G is generated. Upon generation of the signal G, the accumulated coins are delivered to the carrier link 11 to be lowered to the wrapping position H where the wrapping operation takes place. In accordance with the present invention, the subsidiary shutter closing signal B is generated simultaneously with the operation initiation signal A to close the shutter 4 followed by the generation of counting operation initiation signal C after a short delayed time interval to start counting and accumulating coins in the subsidiary accumulator tube 3 prior to the generation of the main shutter opening signal G.

On the contrary, in the conventional wrapping machine, a counting operation initiation signal C′ is generated at the time when the accumulated coins of preceding cycle has been wrapped by the wrapping paper sheet at the wrapping position H, as shown by the dotted line in FIG. 2. As will be clearly understood by comparing the operation schedule of the coin wrapping machine according to the invention with that of the conventional machine, the time t used for counting and accumulating the coins in operation of the machine of the invention can be set longer than the time t′ used for the same operations in the conventional coin wrapping machine, if the total period of time for one cycle operation is not changed. As a result, the operations of the machine, particularly the counting operation, can be controlled more precisely and more reliably by lowering the coin feeding rate determined by the speed of the conveyer belt 8 to reduce the rotational speed of the counting gear 9 on the one hand, or alternatively the time period required for one cycle operation may be reduced to improve the efficiency of the machine by maintaining the coin feeding rate as same as that of the conventional machine.

Although in the foregoing description the coin accumulator tube assembly of the present invention has been incorporated with a coin wrapping mechanism provided with vertical guide means including the carrier link 11, the coin accumulator tube assembly of the invention may be combined with a coin wrapping mechanism having horizontal guide means without any difficulty. For instance, the coin accumulator tube assembly according to the present invention may be modified to be used in combination with the conventional wrapping machine of horizontal guide type wherein the main accumulator tube is partible or opened along a vertical or longitudinal parting line. In this type of modification, a guide tube is mounted swingably or otherwise movably in the horizontal direction between the main accumulator tube and the subsidiary accumulator tube in synchronism with the movement of the clamping rods.

Other modifications and alternations may be made without departing from the principle and spirit of the present invention, and it is intended to include all such modifications and alternations within the scope of the present invention defined in the appended claims.

What is claimed is:

1. A coin accumulator assembly for use in a coin wrapping machine having means for counting coins, means for delivering counted coins to the coin accumulator assembly, a wrapping station for receiving coins from the coin accumulator assembly and for wrapping the received coins, and delivering means for delivering coins from the coin accumulator assembly to the wrapping station, wherein a predetermined number of coins is counted and subsequently accumulated in the coin accumulator tube assembly and then delivered to the wrapping station to be wrapped by a web of wrapping sheet material during each operation cycle, said accumulator assembly comprising:

a stationary main accumulator tube adapted to receive the predetermined number of counted coins;

a main shutter fixedly positioned relative to and just below the main accumulator tube for supporting coins contained within the main accumulator tube when the main shutter is closed and for passing the coins from the main accumulator tube to said delivering means when the main shutter is opened;

a subsidiary accumulator tube fixedly positioned relative to and just above the main accumulator tube and adapted to temporarily receive counted coins therein;

a subsidiary shutter fixedly positioned relative to and between the main accumulator tube and the subsidiary accumulator tube for supporting coins within the subsidiary accumulator tube when the subsidiary shutter is closed and for passing the coins from the subsidiary accumulator tube to the main accumulator tube when the subsidiary shutter is opened;

control means for causing said main and subsidiary shutters to operate according to a predetermined sequence, said sequence including closing the subsidiary shutter to temporarily accumulate counted coins while the main shutter is open to transfer the predetermined number of counted coins to the delivering means and opening the subsidiary shutter, after the main shutter is closed, to deliver coins temporarily accumulated in the subsidiary accumulator tube to the main accumulator tube.

2. A coin accumulator assembly according to claim 1 wherein the length of the main accumulator tube is greater than the length of the subsidiary accumulator tube.

3. A coin accumulator assembly according to claim 1 wherein the length of the main accumulator tube is approximately three times the length of the subsidiary accumulator tube.

4. A coin accumulator assembly according to claim 1, wherein said second means maintains the subsidiary shutter open after coins accumulated in the subsidiary accumulator tube have been passed to the main accumulator tube so that coins subsequently counted during a cycle of operation pass directly into the main accumulator tube.

* * * * *